US008468842B2

(12) United States Patent
Wiggs

(10) Patent No.: US 8,468,842 B2
(45) Date of Patent: Jun. 25, 2013

(54) DX SYSTEM HAVING HEAT TO COOL VALVE

(75) Inventor: B. Ryland Wiggs, Franklin, TN (US)

(73) Assignee: Earth to Air Systems, LLC, Franklin, TN (US)

( * ) Notice: Subject to any disclaimer, the term of this patent is extended or adjusted under 35 U.S.C. 154(b) by 902 days.

(21) Appl. No.: 12/427,512

(22) Filed: Apr. 21, 2009

(65) Prior Publication Data

US 2009/0260378 A1 Oct. 22, 2009

Related U.S. Application Data

(60) Provisional application No. 61/046,660, filed on Apr. 21, 2008.

(51) Int. Cl.
*F25D 21/00* (2006.01)
*F25B 41/04* (2006.01)

(52) U.S. Cl.
USPC ..... 62/150; 62/196.3; 62/217; 62/260

(58) Field of Classification Search
USPC ..... 62/150, 151, 196.1, 196.3, 217, 225, 62/260; 236/92 B
See application file for complete search history.

(56) References Cited

U.S. PATENT DOCUMENTS

| | | | |
|---|---|---|---|
| 2,503,456 | A | 4/1950 | Smith |
| 3,099,140 | A | 7/1963 | Leimbach |
| 3,183,675 | A | 5/1965 | Schroeder |
| 3,452,813 | A | 7/1969 | Watkins et al. |
| 3,986,345 | A | 10/1976 | Pilz et al. |
| 4,010,731 | A | 3/1977 | Harrison |
| 4,094,356 | A | 6/1978 | Ash et al. |
| 4,169,554 | A | 10/1979 | Camp |
| 4,182,133 | A | 1/1980 | Haas et al. |
| 4,189,848 | A | 2/1980 | Ko et al. |
| 4,224,805 | A | 9/1980 | Rothwell |
| 4,257,239 | A | 3/1981 | Partin et al. |
| 4,286,651 | A | 9/1981 | Steiger et al. |
| 4,290,266 | A | 9/1981 | Twite et al. |
| 4,325,228 | A | 4/1982 | Wolf |
| 4,375,831 | A | 3/1983 | Downing, Jr. |
| 4,378,787 | A | 4/1983 | Fleischmann |
| 4,383,419 | A | 5/1983 | Bottum |
| 4,392,531 | A | 7/1983 | Ippolito |
| 4,448,237 | A | 5/1984 | Riley |
| 4,448,238 | A | 5/1984 | Singleton et al. |
| 4,459,752 | A | 7/1984 | Babcock |
| 4,536,765 | A | 8/1985 | Kaminski |
| 4,538,673 | A | 9/1985 | Partin et al. |
| 4,544,021 | A | 10/1985 | Barrett |
| 4,700,550 | A | 10/1987 | Rhodes |
| 4,715,429 | A | 12/1987 | Mogensen |

(Continued)

FOREIGN PATENT DOCUMENTS

| | | |
|---|---|---|
| JP | 57-112699 | 7/1982 |
| JP | 11-182943 | 7/1999 |

*Primary Examiner* — Marc Norman
(74) *Attorney, Agent, or Firm* — Miller, Matthias & Hull LLP

(57) ABSTRACT

Alternative means of inhibiting frosting in the interior heat exchanger of a DX system when switching from the heating mode to the cooling mode, plus an improved insulation and heat transfer means for vertically oriented sub-surface geothermal heat transfer tubing, as well as a means to protectively coat the sub-surface metal tubing of a DX system in a corrosive environment.

12 Claims, 4 Drawing Sheets

U.S. PATENT DOCUMENTS 4,741,388 A 5/1988 Kuroiwa
4,768,348 A * 9/1988 Noguchi ..... 62/225
4,798,056 A 1/1989 Franklin
4,858,679 A 8/1989 Sakaya et al.
4,858,694 A 8/1989 Johnson et al.
4,867,229 A 9/1989 Mogensen
4,936,110 A 6/1990 Kuckens
4,993,483 A 2/1991 Harris
5,025,634 A 6/1991 Dressler
5,025,641 A 6/1991 Broadhurst
5,029,633 A 7/1991 Mann
5,038,580 A 8/1991 Hart
5,054,297 A 10/1991 Furuhama
5,062,276 A 11/1991 Dudley
5,105,633 A 4/1992 Briggs
5,131,238 A 7/1992 Meckler
5,136,855 A 8/1992 Lenarduzzi
5,199,486 A 4/1993 Balmer et al.
5,207,075 A 5/1993 Gundlach
5,224,357 A 7/1993 Galiyano et al.
5,272,879 A 12/1993 Wiggs
5,275,008 A 1/1994 Song et al.
5,277,032 A 1/1994 See et al.
5,313,804 A 5/1994 Kaye
5,381,672 A 1/1995 Haasis
5,383,337 A 1/1995 Baker
5,388,419 A 2/1995 Kaye
5,419,135 A 5/1995 Wiggs
5,461,876 A 10/1995 Dressler
5,477,703 A 12/1995 Hanchar et al.
5,477,914 A 12/1995 Rawlings
5,533,355 A 7/1996 Rawlings
5,560,220 A 10/1996 Cochran
5,561,985 A 10/1996 Cochran
5,564,282 A 10/1996 Kaye
5,598,887 A 2/1997 Ikeda et al.
5,622,057 A 4/1997 Bussjager et al.
5,623,986 A 4/1997 Wiggs
5,651,265 A 7/1997 Grenier
5,671,608 A 9/1997 Wiggs et al.
5,706,888 A 1/1998 Ambs et al.
5,725,047 A 3/1998 Lopez
5,738,164 A 4/1998 Hildebrand
5,758,514 A 6/1998 Genung
5,771,700 A 6/1998 Cochran
5,816,314 A 10/1998 Wiggs et al.
5,875,644 A 3/1999 Ambs et al.
5,934,087 A 8/1999 Watanabe et al.
5,937,665 A 8/1999 Kiessel et al.
5,937,934 A 8/1999 Hildebrand
5,941,238 A 8/1999 Tracy
5,946,928 A 9/1999 Wiggs
6,138,744 A 10/2000 Coffee
6,185,955 B1 * 2/2001 Yamamoto ..... 62/470
6,212,896 B1 4/2001 Genung
6,227,003 B1 5/2001 Smolinsky
6,276,438 B1 8/2001 Amerman et al.
6,354,097 B1 3/2002 Schuster
6,390,183 B2 5/2002 Aoyagi et al.
6,427,464 B1 * 8/2002 Beaverson et al. ..... 62/196.3
6,450,247 B1 9/2002 Raff
6,521,459 B1 2/2003 Schooley et al.
6,615,601 B1 9/2003 Wiggs
6,751,974 B1 6/2004 Wiggs
6,789,608 B1 9/2004 Wiggs
6,892,522 B2 5/2005 Brasz et al.
6,931,879 B1 8/2005 Wiggs
6,932,149 B2 8/2005 Wiggs
6,971,248 B1 12/2005 Wiggs
7,080,524 B2 7/2006 Wiggs
7,146,823 B1 12/2006 Wiggs
7,191,604 B1 3/2007 Wiggs
7,234,314 B1 6/2007 Wiggs
7,401,641 B1 7/2008 Wiggs
7,578,140 B1 8/2009 Wiggs
7,591,145 B1 9/2009 Wiggs
2002/0060250 A1 * 5/2002 Hirota et al. ..... 236/92 B
2002/0132947 A1 9/2002 Smith et al.
2002/0194862 A1 12/2002 Komatsubara
2004/0000399 A1 1/2004 Gavula
2004/0129408 A1 7/2004 Wiggs
2004/0206103 A1 10/2004 Wiggs
2006/0086121 A1 4/2006 Wiggs
2006/0096309 A1 5/2006 Wiggs
2007/0074847 A1 4/2007 Wiggs
2007/0089447 A1 4/2007 Wiggs
2007/0151280 A1 7/2007 Wiggs
2008/0016894 A1 1/2008 Wiggs
2008/0173425 A1 7/2008 Wiggs
2009/0065173 A1 3/2009 Wiggs
2009/0095442 A1 4/2009 Wiggs
2009/0120120 A1 5/2009 Wiggs
2009/0120606 A1 5/2009 Wiggs
2009/0133424 A1 5/2009 Wiggs
2009/0260378 A1 10/2009 Wiggs
2009/0272137 A1 11/2009 Wiggs

* cited by examiner

DX SYSTEM HAVING HEAT TO COOL VALVE

CROSS-REFERENCE TO RELATED APPLICATION

This application claims the benefit of U.S. Provisional Application No. 61/046,660, filed Apr. 21, 2008.

FIELD OF THE DISCLOSURE

This disclosure generally relates to geothermal direct exchange ("DX") heating/cooling systems, commonly referred to as "direct expansion" heating/cooling systems, having various design improvements and specialty applications.

BACKGROUND OF THE DISCLOSURE

A portion of the disclosure of this patent document contains material that is subject to copyright. The copyright owner has no objection to the authorized facsimile reproduction by anyone of the patent document or the patent disclosure, as it appears in the Patent and Trademark Office patent file or records, but otherwise reserves all copyright rights whatsoever.

Geothermal ground source/water source heat exchange systems typically include fluid-filled closed loops of tubing buried in the ground, or submerged in a body of water, that either absorb heat from, or to reject heat into, the naturally occurring geothermal mass and/or water surrounding the buried or submerged fluid transport tubing. The tubing loop is extended to the surface and is then used to circulate the naturally warmed or cooled fluid to an interior air heat exchange means.

Common and older design geothermal water-source heating/cooling systems typically circulate, via a water pump, a fluid comprised of water, or water with anti-freeze, in plastic (typically polyethylene) underground geothermal tubing so as to transfer geothermal heat to or from the ground in a first heat exchange step. Via a second heat exchange step, a refrigerant heat pump system transfers heat to or from the water. Finally, via a third heat exchange step, an interior air handler (comprised of finned tubing and a fan) transfers heat to or from the refrigerant to heat or cool an interior air space.

More recent geothermal DX heat exchange systems have refrigerant fluid transport lines placed directly in the sub-surface ground and/or water. These systems typically circulate a refrigerant fluid, such as R-22, R-410a, or the like, in the sub-surface refrigerant lines, which are typically comprised of copper tubing, to transfer geothermal heat to or from the sub-surface elements via a first heat exchange step. DX systems only require a second heat exchange step to transfer heat to or from the interior air space, typically by means of an interior air handler. Consequently, DX systems are generally more efficient than water-source systems because less heat exchange steps are required and because no water pump energy expenditure is necessary. Further, since copper is a better heat conductor than most plastics, and since the refrigerant fluid circulating within the copper tubing of a DX system generally has a greater temperature differential with the surrounding ground than the water circulating within the plastic tubing of a water-source system, generally, less excavation and drilling is required, and installation costs are lower, with a DX system than with a water-source system.

While most in-ground/in-water DX heat exchange designs are feasible, various improvements have been developed intended to enhance overall system operational efficiencies.

Several such design improvements, particularly in direct expansion/direct exchange geothermal heat pump systems, are taught in U.S. Pat. No. 5,623,986 to Wiggs; in U.S. Pat. No. 5,816,314 to Wiggs, et al.; in U.S. Pat. No. 5,946,928 to Wiggs; and in U.S. Pat. No. 6,615,601 B1 to Wiggs, the disclosures of which are incorporated herein by reference. Such disclosures encompass both horizontally and vertically oriented sub-surface heat geothermal heat exchange means.

The known geothermal heat exchange systems suffer from the following drawbacks:

(1) As DX systems are switched from the heating mode to the cooling mode at the end of a heating season (i.e., when the ground is cold and the refrigerant within the interior heat exchanger, such as an air handler, is at a temperature at or below freezing), it is difficult to obtain a full design refrigerant flow through the system, and the interior heat exchange refrigerant transport tubing tends to "frost," thereby decreasing system operational efficiencies;

(2) The current means for insulating the liquid refrigerant transport line in a sub-surface environment are inadequate; and (3) The refrigerant transport lines are often placed in a sub-surface environment that is corrosive to metal, such as commonly-used copper, and therefore a means for protecting the refrigerant transport lines from corrosion is desirable.

Consequently, a means to provide at least one of full and close to full design refrigerant flow and a means to prevent "frosting" of the interior refrigerant transport heat exchange tubing in a DX system when changing from the heating mode to the cooling mode would be preferable; improvements to insulating the liquid refrigerant transport line in a sub-surface environment mode would be preferable; and a means of protecting all refrigerant transport lines in a sub-surface environment that is corrosive to metal, such as copper for example would be preferable. The present disclosure provides a solution to these preferable objectives, as hereinafter more fully described.

BRIEF SUMMARY OF THE DISCLOSURE

It is an object of this disclosure to further enhance and improve at least one of the efficiency, the longevity, and the interior comfort levels of a DX system when switching from the heating mode to the cooling mode, when refrigerant temperatures within the interior refrigerant heat exchange tubing is at a freezing, or lower, temperature; when insulating the sub-surface liquid refrigerant transport line; and when protecting the sub-surface refrigerant transport lines in a corrosive environment. These objectives are accomplished as follows:

(1) All heat pump systems use expansion devices in the heating mode and in the cooling mode. Some commonly used expansion devices include fixed orifice pin restrictor expansion devices and automatic, self-adjusting, expansion devices, both of which are well understood by those skilled in the art. Expansion devices lower the pressure and temperature of the circulating refrigerant fluid so as to increase the ability of the fluid to absorb heat via providing a greater temperature differential. In DX systems, a unique problem is encountered in moderate to Northern climates when switching from the heating mode to the cooling mode at the end of a heating season. Namely, testing has shown that the ground immediately surrounding the sub-surface, heat transfer, refrigerant transport tubing is sometimes very cold (below freezing), and the heat transfer fluid (a refrigerant) circulating within the tubing can exit the ground at temperatures at or below 52 degrees F., which nearby surrounding ground has had heat removed all winter.

When the refrigerant exiting the ground is at temperatures at, or below, 52 degrees F., as the refrigerant travels through an expansion device in the cooling mode, the refrigerant can drop to a freezing temperature of 32 degrees F., or lower, which results in "frosting" of the interior heat exchange refrigerant tubing. Such frosting results from humidity in the air being attracted via the cold temperatures and then condensing and freezing on the refrigerant transport heat exchange tubing. Such frosting (ice) can significantly reduce interior heat exchange abilities until the refrigerant exiting the ground has sufficiently warmed, via the ground absorbing waste heat rejected in the cooling mode, to a point typically above about 50 degrees F., plus or minus 5 degrees F. Further, when the ground is very cold (near or below freezing), the refrigerant in the sub-surface heat exchanger tends to remain in the coldest area, thereby increasing the difficulty of obtaining optimal refrigerant flow rates.

Thus, it would be advantageous to provide supplemental heat to the interior heat exchange means in such situations, so as to help melt any frosting/ice within the interior heat exchange means and so as to help provide a higher heat level to the sub-surface environment so as to hasten the system's ability to warm the abnormally cold sub-surface environment to a normal temperature range. Such supplemental heat may be supplied via at least one of an external heat source (such as a fossil fuel, electric, solar, or the like, heat supply means) and an internal system heat source (an internal heat source is preferable), such as heat from the high pressure/warm refrigerant side of the heat pump system.

Heat from the high pressure side of the system could come from at least one of the high pressure warm liquid refrigerant exiting the interior heat exchanger and the hot gas vapor refrigerant exiting the compressor (which is depicted in the drawings herein). Extensive testing has demonstrated that merely supplying any amount of supplemental heat, however, is insufficient, as supplying either too little heat or too much heat are both inefficient. Namely, supplying too little supplemental heat will result in continued frosting of the interior heat exchange tubing and excessively low pressure suction operational conditions. On the other hand, supplying too much heat will impair the system's ability to effectively cool the interior air or liquid, since an adequate heat exchange temperature differential is lost.

Therefore, a means of supplying the appropriate amount of supplemental heat to the refrigerant transport tubing within the interior heat exchanger may incorporate at least one of a temperature and a pressure sensing device that engages the supplemental heat supply when the temperature of the refrigerant entering the interior heat exchanger, at a point past the expansion device, is at or below freezing, and that disengages the supplemental heat supply when the temperature of the refrigerant entering the supplemental heat exchanger, at a point past the expansion device, may be at a point within about 5 degrees F. above freezing (within 5 degrees F. above 32 degrees F., where "F" means Fahrenheit). Further, the supplemental heat may be supplied at a point prior to the refrigerant actually entering the interior heat exchanger refrigerant transport tubing for maximum operational efficiencies, which would typically be at a point immediately prior to the refrigerant tubing distributor to the interior heat exchanger.

Such supplemental heat may be supplied via a valve that automatically opens to permit at least one of hot gas/vapor refrigerant (originating from the system's compressor) and warm liquid/fluid refrigerant (exiting the system's interior heat exchanger) to provide supplemental heat to the refrigerant entering the interior heat exchanger, and that may automatically close when the temperature of the refrigerant entering the interior heat exchanger reaches a predetermined temperature, such as no more than about 5 degrees F. greater than freezing. The drawings herein depict supplemental heat being supplied to the interior heat exchange means (herein depicted as an air handler, which is well understood by those skilled in the art) from a small secondary refrigerant hot gas line exiting the primary hot gas discharge line side of the system. The smaller secondary hot gas line exits the high pressure side of the DX system at a point past the system's compressor and oil separator, but before the hot gas travels into the sub-surface geology to reject heat into the ground. The automatic valve disclosed herein may be provided with hot gas after the hot refrigerant gas has exited the system's oil separator, and an oil separator that is at least 99% efficient may be incorporated into the system design, to avoid sending too much oil to the automatic valve, as would happen if the hot gas is sent directly into the automatic valve from the compressor.

In a DX system application, a common "TXV" (a "Thermal Expansion Valve", also sometimes called a "TEV") cooling mode expansion device (which are well understood by those skilled in the art) typically lowers the temperature of the refrigerant fluid entering the interior heat exchanger by about 13 degrees F., plus or minus about 3 degrees F. It would be well understood by those skilled in the art that differing expansion devices could have differing temperature drop ranges (and corresponding pressure drop ranges) other than a common approximate 10 to 16 degree F. common temperature drop range. In such event, the problem addressed herein would apply to any situation where the refrigerant traveling into the interior air handler, or other heat exchange means, was at or below the freezing point.

Thus, a means of both increasing the refrigerant flow rate to a design flow rate, without full design refrigerant flow being impaired because of a very cold sub-surface environment tending to "keep" the refrigerant in the coldest location, and increasing the temperature of the refrigerant entering the interior heat exchanger (the interior heat exchanger is typically an air handler comprised of finned tubing, but may also be comprised of a refrigerant to water/liquid heat exchanger, or the like, all of which are well understood by those skilled in the art) to a point above freezing may be desirable during such a heating to cooling mode transition period.

While previous proprietary testing has demonstrated that at least one of a by-pass line around a self-adjusting thermostatic expansion valve/device ("TXV") and a bleed port through a TXV may be required to facilitate adequate refrigerant fluid flow in a cooling mode system operation at the beginning of a cooling season when the sub-surface ground temperature is abnormally cold (via heat being withdrawn throughout the winter), an improved means of facilitating DX system operation under such conditions, in the cooling mode, may be to provide an automatically adjusting/operating valve to supply and control at least one of a limited amount of hot refrigerant discharge gas (originating from the system's compressor) and a warm refrigerant vapor (originating from the refrigerant exiting the system's interior heat exchanger) to the cold liquid refrigerant transport line entering the interior heat exchanger, at a point subsequent to the cooling mode TXV and before the distributor to the interior heat exchanger. The limited/controlled hot/warm refrigerant both increases the suction pressure of the system and provides heat to keep frosting within the interior air handler to a minimum.

Such an automatically operating valve (an "AV" for "Automatically operating Valve") may begin to close itself off, so as to begin stopping the hot/warm refrigerant from entering the cold liquid refrigerant line to the interior heat exchanger, at about 75 psi, and the valve may modulate so as to fully close itself off when about 95 psi is reached in the subject liquid refrigerant transport line into the interior air handler, at a point prior to the distributor to the air handler. The valve (when transferring hot gas refrigerant originating from the system's compressor) may transfer the hot gas into the cold liquid refrigerant transport line, exiting the interior air handler's automatic expansion device (commonly referred to as a "TXV" and/or as an "AEV"), but before the line reaches the distributor to the interior heat exchange means. The valve transfers such hot gas, originating from the system's compressor (which may be taken after exiting the system's oil separator), via what is herein termed as a "hot gas by-pass line" because the hot refrigerant gas by-passes its normal route into the ground in the cooling mode of a DX system design. The valve would incorporate a primary hot gas by-pass line, a pressure sensing/equalization refrigerant transport line, a capillary tube with a sealed end, and a cap that would be pre-charged with a gas at an appropriate psi. The hot gas passing through the valve would be mixed into the cold refrigerant entering the interior heat exchanger by means of a side port diffuser, so as to assist in mixing the hot gas with the cold liquid refrigerant.

As an alternative, the automatic valve, which would otherwise be fully open, can operate to fully close itself off when at least about 95 psi is reached on the subject liquid refrigerant transport line into the interior air handler, at a point subsequent to the cooling mode TXV and prior to the distributor to the air handler. The valve may have a pressure sensitive cap filled with gas, such as dry nitrogen gas or the like, at a pressure of about 85 psi, to offset the valve spring adjustment when the valve, if adjustable, is equivalent to the valve identified below in a fully opened position.

A suitable valve, but with at least 85 psi of gas, such as dry nitrogen gas, or the like, in its pressure sensitive cap (which valve and cap are well understood by those skilled in the art), instead of other standard factory cap pressure settings of 95 psi to 115 psi for example, would be a Sporlan Valve HGBE-5-95/115, as manufactured by the Sporlan Division of the Parker Hannifin Corporation, of 206 Lange Drive, Washington, Mo. 63090. Other valves may be utilized that have similar operational equivalencies.

Detailed testing has shown that if the cap pressure is too high (such as above approximately 85 psi), there will be no cooling effect as too much hot gas is being sent through the interior heat exchanger (an air handler or the like), and if the cap pressure is too low (such as below about 85 psi), too little refrigerant is permitted to by-pass the TXV so as to result in too much ice build-up within the interior heat exchanger, so as to inhibit heat exchange with the interior air.

As another alternative, an electronic valve, with pre-determined, settings, could be used in lieu of the automatically operating valve described hereinabove, however, electronic valves are not preferable in that every electronic component added to a DX system complicates the system and provides added component failure risks, thereby potentially impairing the preferred optimum durability of the DX system design. However, if an electronic valve were used for such purpose, the electronic valve settings may be designed to operate within the herein disclosed design parameters. As one alternative, the electronic automatic valve could be programmed to remain fully open at a pressure point below, and to fully close at a pressure point above, about 95 psi in the liquid refrigerant transport line, leading into the interior air handler, at a point after the TXV and prior to the distributor to the air handler. An electronic valve is not shown in detail herein as same would be well understood by those skilled in the art, so long as the valve is set to operate at the disclosed pressures.

An alternate means of preventing frosting on the exterior of the refrigerant transport tubing within the interior heat exchanger of a DX system, initially operating in the cooling mode when the sub-surface environment is colder than about 45 degrees F. (such as at the conclusion of a heating season), may be to provide a valve that automatically opens to permit hot gas/vapor refrigerant, exiting from the system's compressor, to enter the refrigerant vapor line exiting the interior heat exchange means, before the vapor exiting the interior heat exchanger enters the system's accumulator, so as to exert a high enough back-pressure on the refrigerant within the interior heat exchanger to increase the temperature of the refrigerant within the interior heat exchanger so as to prevent frosting of the interior heat exchanger.

The automatic valve may have a cap (with a capillary tube with a sealed end) filled with a gas (such as dry nitrogen or the like), and the valve has a pressure sensing/equalization refrigerant transport line situated at least about twelve inches downstream, in the refrigerant flow direction, from the point where the hot gas, originally traveling from the compressor and through the valve, enters the refrigerant vapor line exiting the interior heat exchange means. Testing has indicated the cap of the valve, when utilizing a valve such as the above-identified Sporlan valve, or the like, may be filled with dry nitrogen, at a pressure of 110 psi, for a system operating on an R-410A refrigerant. Correspondingly appropriate pressure setting (so as to prevent air handler frosting) would be utilized for other refrigerants operating at other pressures, as would be well understood by those skilled in the art. Valves serving as hot gas by-pass valves are well known, but have not been used to exert back-pressure on the refrigerant within an interior air handler to prevent frosting, as taught herein for a DX system. The hot gas refrigerant sent to the interior heat exchanger by the valve, in the cooling mode, may be taken from hot gas refrigerant line exiting at least one of the system's compressor and the system's oil separator. The hot gas may be introduced to the warm refrigerant exiting the interior heat exchanger/air handler at a point past the air handler's TXV, but before the system's accumulator. TXVs and accumulators are well understood by those skilled in the art. In such a design, testing has shown that a side port diffuser may be unnecessary, as the hot gas is being mixed with warm gas, as opposed to being mixed with a cold liquid phase refrigerant.

(2) A second design improvement is a means of better insulating the liquid refrigerant transport line in a sub-surface environment. This may be accomplished by surrounding the sub-surface, cooler, liquid refrigerant transport tubing, typically in the immediate proximity of the sub-surface heat exchange, warmer, vapor refrigerant transport tubing, with a solid insulation material that cannot be crushed via sub-surface pressures. Testing has shown that sub-surface pressures, such as water pressures, ground weight pressures, grouting pressures, and the like, over time, tend to compress and reduce expanded foam type insulations, thereby impairing insulation abilities. Therefore, a solid type insulation material may be used, particularly at depths exceeding 50 feet.

However, for both efficiency and cost effective concerns, testing has demonstrated there are two preferable means for installing such sub-surface, solid state, insulation around the cooler liquid/fluid refrigerant transport line (which is not the heat exchange line), particularly in a Deep Well Direct Exchange ("DWDX" system), where the refrigerant transport liquid and vapor lines are typically vertically oriented and are installed within the same borehole at depths in excess of 100 feet.

The first type of insulation means would be comprised of a coating for a metal refrigerant transport tube (typically copper), which coating would be comprised of a low heat conductivity plastic, such as a preferable low density polyethylene, or the like, where the insulating coating may be at least 0.1 inches thick. Testing has shown a low density polyethylene provides better insulation values in such an application than a high-density polyethylene. An alternative solid-state coating could be utilized, such as another type plastic and/or a rubber material or the like, so long as the heat conductivity rate did not exceed approximately 0.25 BTUs/Ft.Hr. degrees F.

Additionally, in such an application, expanded foam, closed cell, plastic insulation, such as expanded foam polyethylene or the like, should additionally be placed around the exterior of the solid state plastic coating on the liquid refrigerant transport line, which foam has a minimum insulation wall thickness of at least ½ inch, and which foam may be installed from the ground surface to a depth of at least 50 feet. In such an application, the heat conductivity rate of the expanded foam may also not exceed 0.25 BTUs/Ft.Hr. degrees F.

Polyethylene generally has a heat transfer rate of only about 0.225 BTUs/Ft.Hr. degrees F., which may be a relatively poor heat conductivity rate. By comparison, copper has a heat conductivity rate of about 227 BTUs/Ft.Hr. degrees F.

Additionally, testing has shown that in such an application, about the lower 15% of the liquid refrigerant transport line in a DWDX system application (the lower approximate 15% of the vertically oriented sub-surface liquid refrigerant transport line) may be left uncoated/un-insulated for heat transfer and cost effectiveness advantages. Factually, testing has indicated a geothermal heat transfer advantage when the lower approximate 15% of vertically oriented liquid refrigerant transport tubing is left completely un-insulated, together with completely un-insulated vertically oriented vapor refrigerant transport tubing.

An alternate type of insulation means would be comprised of sliding (as opposed to coating) a separate polyethylene tube, or the like, or any similar solid-state insulation tube material having a heat conductivity rate that did not exceed 0.25 BTUs/Ft.Hr. degrees F., over the sub-surface liquid/fluid refrigerant transport line, as opposed to applying a solid-state coating in a manufacturing process. Regardless of the application means, the solid-state insulation may surround the insulated portion of the sub-surface liquid refrigerant transport line and may not exceed a heat transfer rate of 0.25 BTUs/Ft.Hr.

In any such application, unless the wall thickness of the solid-state insulation material was at least 0.2 inches thick, expanded foam, closed cell, plastic insulation, such as expanded foam polyethylene or the like, should additionally be placed around the exterior of the separate solid state plastic tubing surrounding the liquid refrigerant transport line, which foam has a minimum insulation wall thickness of at least ½ inch, with the foam insulation being installed from the ground surface to a depth of at least 50 feet. In such an application, the heat conductivity rate of the expanded foam may also not exceed 0.25 BTUs/Ft.Hr. degrees F.

When a metal liquid/fluid refrigerant transport tube is being installed in a DWDX system application, or otherwise, with another separate tube of a solid state insulation material, such as polyethylene, or the like, being utilized for insulation purposes, the insulating tube may have a heat conductivity rate that does not exceed 0.25 BTUs/Ft.Hr. degrees F. and may have a wall thickness of at least approximately 0.2 inches thick so as to inhibit heat transfer to the metal refrigerant transport tube inside the insulation tubing. The insulation tubing may be installed via sliding the insulation tubing down around the metal refrigerant transport tube from the top of the well/borehole once the metal refrigerant transport tube has been installed in the well.

There is necessarily a gap between the two respective tubes. The gap will be full of air in a dry sub-surface installation and will be full of water in a wet sub-surface installation. The air gap in a dry sub-surface installation will provide better insulation properties, but the insulation tubing will still provide adequate heat transfer inhibition even if water filled.

(3) A third design improvement is a means of protecting all refrigerant transport lines in a sub-surface environment that is corrosive to metal, such as copper for example. For example, soils with PH levels between 5.5 and 11 can be corrosive to copper. In such situations, all sub-surface metal refrigerant transport tubing may be coated with a protective solid-state coating that is non-corrosive via the adjacent geology, such as polyethylene, or the like. However, in such situations, while the sub-surface liquid/fluid refrigerant transport tubing may be coated with a thicker coating, as described hereinabove so as to inhibit heat transfer, the sub-surface vapor/fluid refrigerant transport line may be coated with a protective coating that is non-corrosive via the adjacent geology, such as polyethylene, or the like, with as thin as possible a coating so as not to unduly impair heat conductivity/transfer.

Testing has demonstrated that such an acceptable solid-state coating on the sub-surface vapor refrigerant transport line, as well as on any otherwise uncoated portions of the liquid refrigerant transport line, may be comprised of a solid-state polyethylene coating that is between 0.01 and 0.02 inches thick. Such a coating will have less than an approximate 10% heat transfer impairment. A coating less than 0.01 inches thick may be too easily damaged, and a coating of more than 0.02 inches thick may impair heat transfer to an unacceptable level.

As mentioned above, a preferable coating on most of the sub-surface metal liquid line should be comprised of a solid-state polyethylene coating, or the like, that may have a thickness of at least approximately 0.1 inches. Such a coating may protect the metal liquid line, as well as inhibit unwanted heat transfer.

DETAILED DESCRIPTION

The following detailed description is of the best presently contemplated mode of carrying out the subject matter disclosed herein. The description is not intended in a limiting sense, and is made solely for the purpose of illustrating the general principles of this subject matter. The various features and advantages of the present disclosure may be more readily understood with reference to the following detailed description taken in conjunction with the accompanying drawings. As used herein, the word "about", when referring to temperatures and/or pressures, means approximately.

Figure 1:
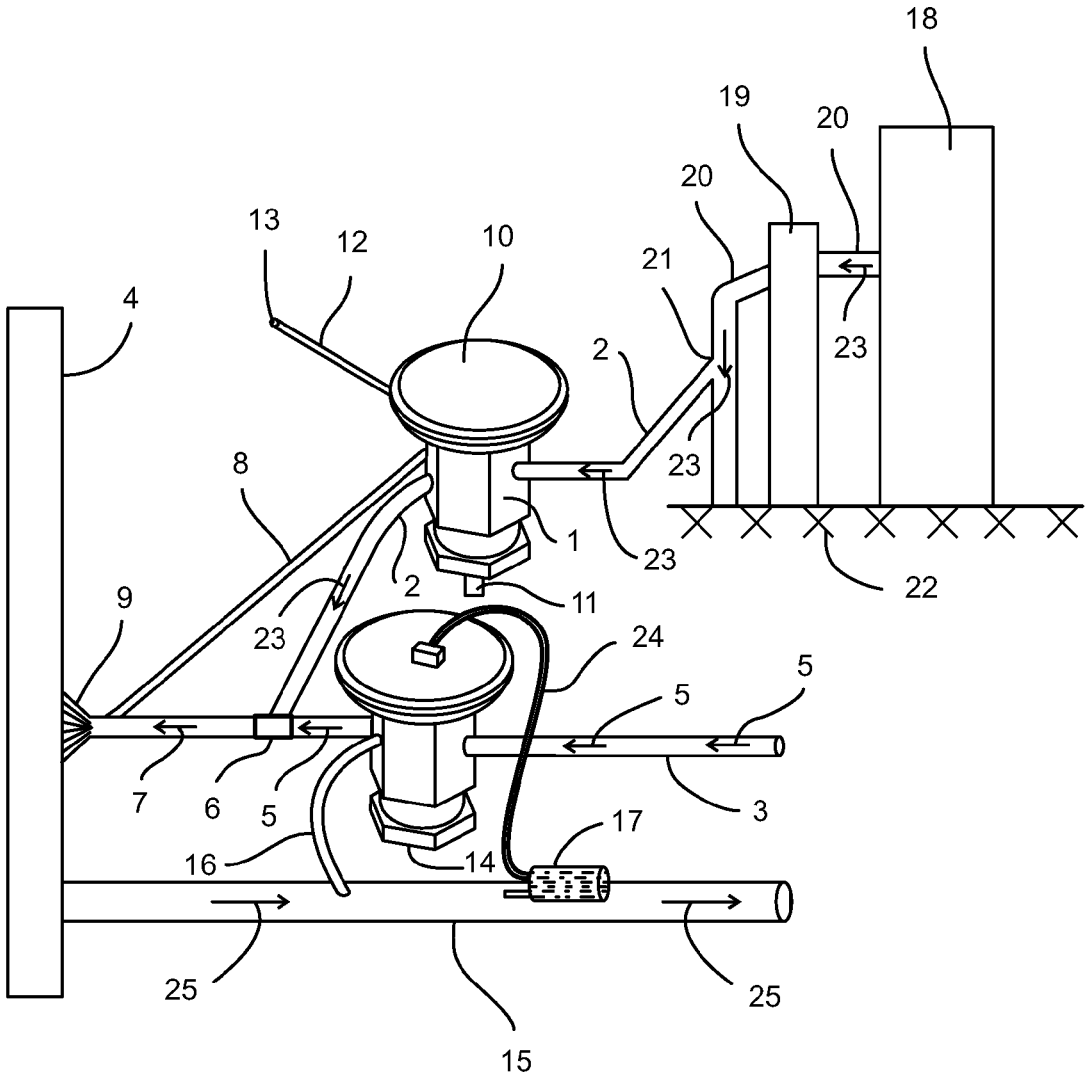
FIG. 1 is a side view, not drawn to scale, of an automatic self-adjusting valve incorporated into a geothermal system, operating in the cooling mode, according to the present disclosure.

Referring now to the drawings in detail, where like numerals refer to like parts or elements, there is shown in FIG. 1 a side view, not drawn to scale, of an automatic self-adjusting valve 1 that is situated in a smaller hot gas by-pass refrigerant transport line 2.

The drawings herein depict supplemental heat being supplied to the interior heat exchange means 4 (herein depicted as an air handler, which is well understood by those skilled in the art) from a small secondary refrigerant hot gas by-pass line 2 exiting the primary hot gas discharge line 20 side of the system (for clarity, the entire system is not shown herein in detail, but the components and layout of such a system would be generally understood by those skilled in the art).

The smaller secondary hot gas by-pass line 2 exits the high pressure side of the DX system at a point 21 past the system's compressor 18 and past the system's oil separator 19, but before the hot gas (not shown but depicted by arrow 23) travels into the sub-surface geology to reject heat into the ground 22. The automatic valve 1 may automatically close when the temperature of the mixed refrigerant fluid 7 entering the interior heat exchanger 4 (typically an air handler 4, which is well understood by those skilled in the art) reaches a predetermined temperature, such as no more than about five degrees F. greater than freezing. The mixed refrigerant fluid (not shown but depicted by arrow 7) may be comprised of liquid refrigerant (not shown but depicted by arrow 5) within the primary liquid refrigerant transport line 3 mixed with hot gas refrigerant (not shown but depicted by arrow 23) originating from the system's compressor 18.

The hot gas 23 from the high pressure compressor 18 side of the system travels through a primary hot gas refrigerant transport line 20 into the oil separator 19. After exiting the oil separator 19, the hot gas 23 reaches a point 21 where it travels into a smaller secondary hot gas refrigerant transport line 2 to the automatic valve 1 and from the automatic valve 1 back into the primary liquid refrigerant transport line 3, bringing cooled mostly liquid refrigerant from the sub-surface heat exchanger (not shown herein as same would be well understood by those skilled in the art) in the cooling mode. The automatic valve 1 is herein shown with a cap 10 that may be filled with dry nitrogen or the like (not shown) at a cap pressure of approximately 85 psi. The cap 10 may be filled with the gas via a small capillary tube 12 with a permanently sealed end 13. The automatic valve 1 is also herein shown with an adjustment screw 11 in a fully opened position. Caps 10, capillary tubes 12, and adjustment screws 11 are all well understood by those skilled in the art.

The hot gas refrigerant fluid (not shown except by directional arrows 23) flowing from the automatic valve 1 enters the primary liquid line 3 through a side port diffuser 6. A side port diffuser 6 is well understood by those skilled in the art, and is essentially a mixing chamber to mix the cold mostly liquid refrigerant fluid (not shown except by directional arrow 5) flowing within the primary liquid line 3 with the hot gas refrigerant fluid 23 flowing out of the automatic valve 1.

The mixed refrigerant fluid 7 next flows past a pressure sensing/equalization refrigerant transport line 8, which line 8 extends to the automatic valve 1. After passing the pressure sensing/equalization line 8, the mixed refrigerant fluid 7 next flows into a distributor 9. Distributors 9 are well understood by those skilled in the art and essentially consist of an equal distribution means of a larger refrigerant fluid flow into multiple smaller refrigerant tubes (not shown herein as same are well understood by those skilled in the art) within the interior heat exchanger 4 so as to effect an efficient heat exchange.

The hot gas by-pass line 2 containing the automatic valve 1 is shown as traveling around, and by-passing, a standard self-adjusting Thermal Expansion Valve 14 (a "TXV" or a "TEV"). TXVs 14 are well understood by those skilled in the art. The TXV 14 may be a standard TXV valve, herein shown with a vapor pressure sensing tube 16 extending from the TXV 14 to the primary vapor refrigerant transport line 15, and with a temperature sensor 17 attached via a sensor tube 24 directly to the primary vapor line 15, which vapor line 15 is transporting mostly vapor refrigerant (not shown but depicted by arrows 25) with heat acquired from the interior heat exchange means 4, herein shown as an air handler 4, as is well understood by those skilled in the art.

Although not shown herein, an electronically controlled valve, which is well understood by those skilled in the art, could be substituted in lieu of the automatic self-adjusting valve 1, so long as the operative pressure settings disclosed herein are programmed in and utilized.

Figure 2:
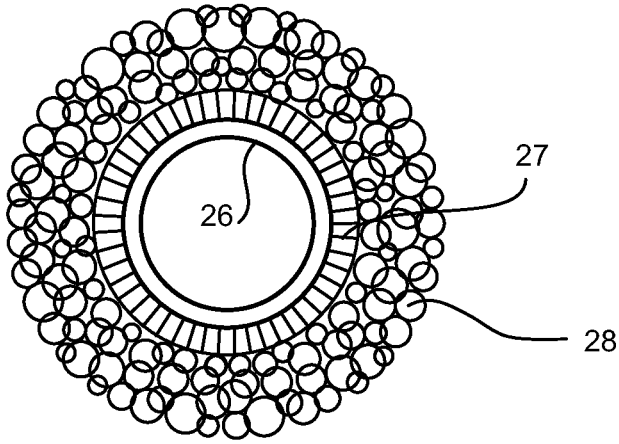
FIG. 2 is a top view of a metal liquid/fluid refrigerant transport tube with a coating of a solid state insulation material, according to the present disclosure.

FIG. 2 is a top view of a metal liquid/fluid refrigerant transport tube 26 with a coating 27 of a solid state insulation material, such as polyethylene, or the like. The coating 27, not drawn to scale, may be at least approximately 0.1 inches thick so as to inhibit heat transfer to the metal tube 26 inside the coating 27. Additionally, an extra layer of expanded foam, closed cell, insulation 28, which insulation 28 has at least a one-half inch foam wall thickness (not drawn to scale), is shown surrounding the coating 26. The expanded foam insulation 28 may have closed cells so as not to absorb water and decrease insulation values.

Figure 3:
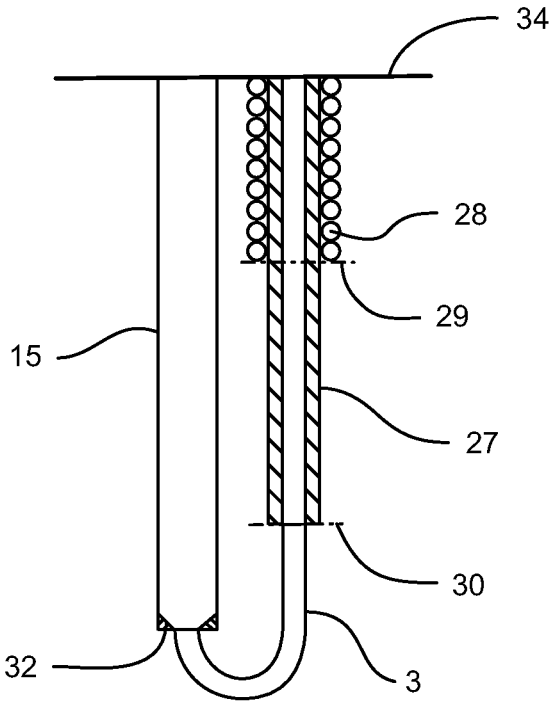
FIG. 3 is a side view of a vertically oriented liquid/fluid refrigerant transport line with a coating of a solid state insulation material, according to the present disclosure.

FIG. 3 is a side view of a vertically oriented liquid/fluid refrigerant transport line 3, with a coating 27 of a solid state insulation material, such as polyethylene, or the like. A first or upper section of the transport line 3, extending from the top/surface 34 to a depth 29 of at least 50 feet (not drawn to scale), includes an extra layer of expanded foam, closed cell, insulation 28 having at least a one-half inch foam wall thickness (not drawn to scale) surrounding the coating 27. Additionally, a second or intermediate section of the transport line 3, extending from the depth 29 to a further depth 30, encompasses the lower 15% (not drawn to scale) of the liquid line 3 from the bottom up and has no insulation layer 28 at all. Here, the liquid line 3 is shown as coupled 32 to a larger diameter and un-insulated vapor refrigerant transport line 15 used for sub-surface heat transfer, as is well understood by those skilled in the art.

Figure 4:
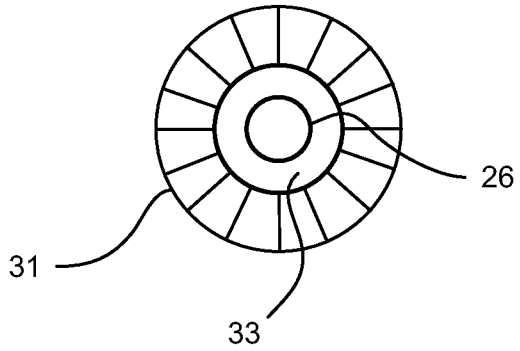
FIG. 4 is a top view of a metal liquid/fluid refrigerant transport tube within a separate tube of a solid state insulation material, according to the present disclosure.

FIG. 4 is a top view of a metal liquid/fluid refrigerant transport tube 26 within a separate tube 31 of a solid state insulation material, such as polyethylene, or the like. The tube 31, not drawn to scale, may have a heat conductivity rate that does not exceed approximately 0.25 BTUs/Ft.Hr. degrees F. and may have a wall thickness of at least approximately 0.2 inches thick so as to inhibit heat transfer to the metal refrigerant transport tube 26 inside the insulation tubing 31. The insulation tubing 31 may be installed via sliding the insulation tubing 31 down around the metal refrigerant transport tube 26 once the metal refrigerant transport tube 26 has been installed in a vertically oriented well (not shown as same is well understood by those skilled in the art) of a DWDX, or other DX, system.

There is necessarily a gap 33 between the two respective tubes 26 and 31. The gap 33 will be full of air in a dry sub-surface installation and will be full of water in a wet sub-surface installation. The air gap 33 in a dry sub-surface installation will provide better insulation properties, but the insulation tubing 31 will still provide adequate heat transfer inhibition even if water-filled.

Figure 5:
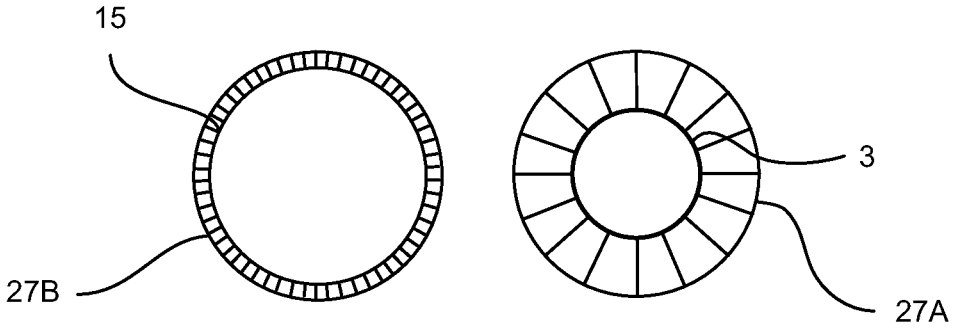
FIG. 5 is a top view of a primary liquid refrigerant transport line and of a larger vapor refrigerant transport line that have both been surrounded by a protective respective solid-state insulating coating to protect the metal refrigerant transport tubing in sub-surface environments that are corrosive to the metal type utilized for the line, according to the present disclosure.

FIG. 5 is a top view of a primary liquid refrigerant transport line 3 and of a larger vapor refrigerant transport line 15 that have both been surrounded by a protective respective solid-state insulating coating 27A and 27B to protect the metal refrigerant transport tubing, 3 and 15, in sub-surface environments that are corrosive to the metal type utilized (typically copper).

A preferable solid-state coating 27B on the sub-surface vapor refrigerant transport line 15 may be comprised of a solid-state polyethylene coating 27B, or the like, having a thickness of approximately 0.01-0.02 inches. Such a coating 27B may impair heat transfer by less than approximately 10%. A coating less than approximately 0.01 inches thick may be too easily damaged, while a coating of more than 0.02 inches thick may impair heat transfer by an unacceptable level.

A coating 27A on the sub-surface liquid refrigerant transport line 3 may be comprised of a layer of solid-state polyethylene, or the like, which may be at least approximately 0.1 inches thick.

Figure 6:
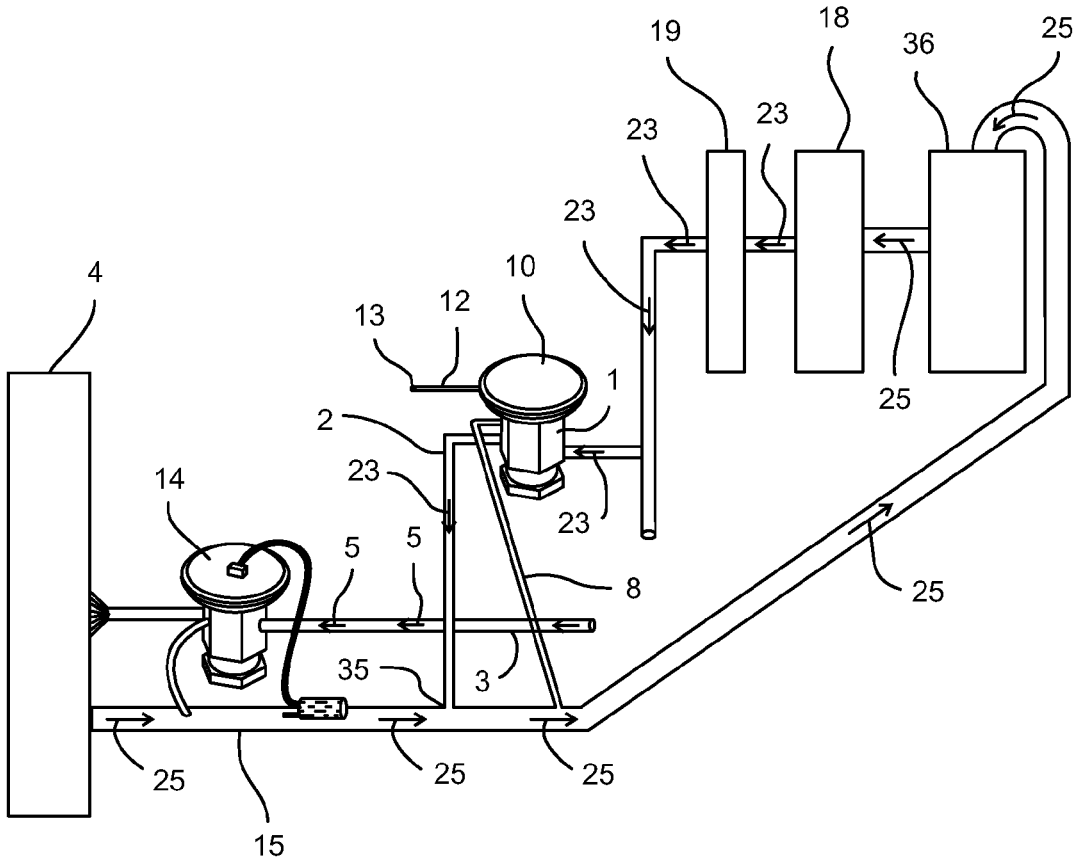
FIG. 6 is a side view of an automatic hot gas by-pass valve utilized to place back-pressure on the refrigerant within the interior air handler, by directing high pressure refrigerant vapor, originating from the system's compressor, into the warm vapor refrigerant transport line exiting the air handler in the cooling mode.

FIG. 6 is a side view of an automatic and self-adjusting hot gas by-pass valve 1 for placing back-pressure on the mostly vapor refrigerant 25 within the interior heat exchanger/air handler 4, by directing high pressure and hot gas 23 refrigerant, originating from the system's compressor 18, but exiting the system's oil separator 19, into the warm mostly vapor refrigerant 25 vapor refrigerant transport line 15 exiting the air handler 4 in the cooling mode. In this application, the valve 1 has a cap 10, with a capillary tube 12 with a sealed end 13, which may be filled with a gas pressurized to approximately 110 psi, for use with a refrigerant such as R-410A. The valve's 1 hot gas by-pass refrigerant transport line 2 has a connecting point 35 with the vapor refrigerant transport line 15 exiting the air handler 4 after the air handler's 4 TXV 14, but before the system's accumulator 36, through which mostly vapor refrigerant 25 passes on its way back to the compressor 18. Here, the valve's 1 pressure sensing/equalization refrigerant transport line 8 is operably coupled to the vapor refrigerant transport line 15, leading to the accumulator 36, at a location that is at least about one foot (not drawn to scale) downstream (in the mostly refrigerant vapor 25 flow) from the connecting point 35, where the hot gas by-pass refrigerant transport line 2 connects to the vapor refrigerant transport line 15 exiting the interior heat exchanger/air handler 4 in the cooling mode. Accumulators 36 are well understood by those skilled in the art. Mostly liquid refrigerant 5 is shown entering the TXV 14 (which is more fully described in FIG. 1 above) through the primary liquid refrigerant transport line 3.

What is claimed is:

1. A direct exchange heating and cooling system operable in a cooling mode, comprising:

a compressor having a compressor inlet and a compressor outlet;

an exterior sub-surface heat exchanger;

an interior heat exchanger having an interior heat exchanger inlet and an interior heat exchanger outlet;

a liquid refrigerant transport line extending from the exterior sub-surface heat exchanger to the interior heat exchanger inlet;

a vapor refrigerant transport line extending from the interior heat exchanger outlet to the compressor inlet;

a hot gas discharge line extending from the compressor outlet to the exterior sub-surface heat exchanger;

a bypass line fluidly communicating between the hot gas discharge line and a connection point provided on the vapor refrigerant transport line; and a bypass valve disposed in the bypass line, the bypass valve having a normally closed position and being configured to selectively open to directly communicate heated refrigerant from the hot gas discharge line to the vapor refrigerant transport line, wherein the connection point is sufficiently proximate the interior heat exchanger outlet so that the heated refrigerant from the hot gas discharge line generates a back pressure in the interior heat exchanger.

2. The direct exchange heating and cooling system of claim 1, in which the bypass valve comprises an automatic valve.

3. The direct exchange heating and cooling system of claim 2, in which the automatic valve includes a pressure sensitive cap configured to actuate the automatic valve between open and closed positions.

4. The direct exchange heating and cooling system of claim 3, in which the pressure sensitive cap includes a biasing mechanism configured to bias the automatic valve toward the closed position.

5. The direct exchange heating and cooling system of claim 4, in which the biasing mechanism comprises a charge of gas.

6. The direct exchange heating and cooling system of claim 5, in which the heated refrigerant comprises R-410A refrigerant, and in which the charge of gas has a pressure of approximately 110 psi.

7. The direct exchange heating and cooling system of claim 2, in which the automatic valve comprises a pressure sensing line fluidly communicating with the vapor refrigerant transport line at a sensing point located downstream of the connection point.

8. The direct exchange heating and cooling system of claim 7, in which the sensing point is at least approximately 12 inches downstream of the connection point.

9. The direct exchange heating and cooling system of claim 1, further comprising a cooling mode expansion device disposed in the liquid refrigerant transport line.

10. The direct exchange heating and cooling system of claim 9, in which the cooling mode expansion device comprises a thermal expansion valve having a vapor pressure sensing tube in fluid communication with the vapor refrigerant transport line upstream of the connection point, and a temperature sensor in thermal communication with the vapor refrigerant transport line.

11. The direct exchange heating and cooling system of claim 1, further comprising an oil separator disposed in the hot gas discharge line upstream of the bypass line.

12. The direct exchange heating and cooling system of claim 1, further comprising an accumulator disposed in the vapor refrigerant transport line downstream of the connection point.

* * * * *